United States Patent [19]

Howell

[11] Patent Number: 4,583,066

[45] Date of Patent: Apr. 15, 1986

[54] THERMAL RELEASE FOR FLUX SHIFT TRIP UNIT WITHIN STATIC TRIP CIRCUIT BREAKERS

[75] Inventor: Edward K. Howell, Simsbury, Conn.

[73] Assignee: General Electric Company, New York, N.Y.

[21] Appl. No.: 678,209

[22] Filed: Dec. 5, 1984

[51] Int. Cl.[4] ..... H01H 9/00

[52] U.S. Cl. ..... 335/229; 335/142; 335/173

[58] Field of Search ..... 335/229, 330, 234, 236, 335/218, 142, 173, 174; 137/77

[56] References Cited

U.S. PATENT DOCUMENTS 1,544,138 6/1925 Dreyer ..... 335/142

2,694,789 11/1954 Wilckens ..... 335/142

4,288,770 9/1981 Gillette ..... 335/173

*Primary Examiner*—Harold Broome

*Attorney, Agent, or Firm*—Richard Menelly; Walter Bernkopf; Fred Jacob

[57] ABSTRACT

A flux shifting circuit breaker trip device is disclosed which includes a permanent magnet for retaining a solenoid armature in opposition to a spring force. Energization of the solenoid winding produces a magnetic flux in opposition to the permanent magnet flux to extend the armature under the spring force. In order to provide ambient temperature response, the solenoid armature is formed from a stem part and a barrel part held together by a meltable material. Increase in ambient temperature above a predetermined value causes the material to melt allowing the stem part to extend under the spring force to trip the breaker.

14 Claims, 2 Drawing Figures

THERMAL RELEASE FOR FLUX SHIFT TRIP UNIT WITHIN STATIC TRIP CIRCUIT BREAKERS

BACKGROUND OF THE INVENTION

Static trip circuit breakers generally employ means other than thermally responsive elements for sensing fault conditions and for tripping the breaker. U.S. Pat. Nos. 3,803,455; 4,038,618; 4,209,818 and 4,312,165 describe various means for making the circuit breaker responsive to ambient temperature conditions. U.S. Pat. Nos. 4,288,769 and 4,288,770 describe methods for providing temperature responsive means to flux shifting trip devices.

The primary purpose of the present invention is to provide a simple and economical means for tripping a flux shifting circuit breaker trip device when the temperature of the circuit breaker enclosure exceeds a predetermined value.

SUMMARY OF THE INVENTION

The invention comprises an ambient temperature responsive trip device for static trip circuit breakers which includes a solenoid and a two component solenoid armature made of a stem part held within a barrel part by means of a meltable metal alloy or a meltable adhesive. The solenoid armature is held from becoming extended under a spring force by a magnetic force supplied by a permanent magnet. The breaker is tripped by energizing the solenoid to produce a magnetic field in opposition to the magnetic field of the permanent magnet. In the event of the occurrence of an ambient temperature in excess of the melting temperature of the alloy, the stem separates from the barrel and becomes extended under the influence of the spring force. Mechanical latching of the breaker forces the two armature components back into contact while the alloy remains in a melted state. Upon cooling to a temperature below the melting point of the alloy, the two components are held together until such time as the ambient temperature increases beyond the predetermined melting point of the alloy.

DESCRIPTION OF THE PREFERRED EMBODIMENT

Figure 1:
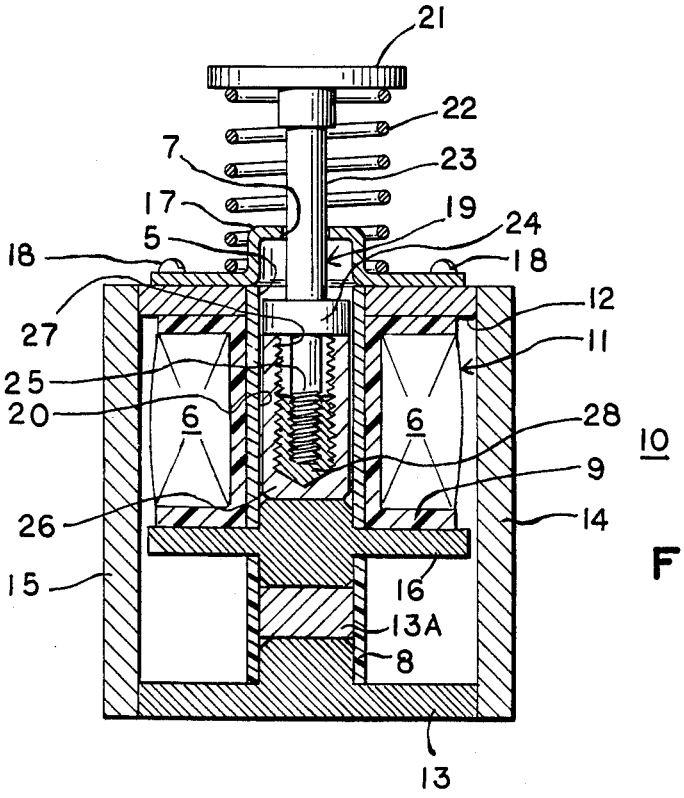
FIG. 1 is a side view in partial section, of an ambient temperature responsive trip device according to the invention.

FIG. 1 contains a static trip flux shift unit 10 such as used within the circuits described within U.S. Pat. Nos. 4,038,695 and 4,266,259. Unit 10 consists of a solenoid 11 retained within an upper end wall 12 at one end, a permanent magnet 13A and a lower end wall 13 at an opposing end. A pair of opposing sidewalls 14, 15 of magnetically susceptible material house a cylinder 8 made of non-magnetic material and a spool 9 also made from an insulative material such as a plastic resin. Solenoid 11 contains a solenoid winding 6 arranged around spool 9 which includes a brass sleeve 5. A flux diverter cylindrical member 16 is arranged beneath winding 6 and close to opposing sidewalls 14, 15. A more complete description of the flux diverter is given in U.S. Pat. No. 3,693,122 which is incorporated herein for purposes of reference. An armature stop 17 is fastened to upper end wall 12 by means of screws 18 for the purpose of retaining an armature 19 partly within winding 6. Armature 19 contains a stem part 23 supported within opening 7 through stop 17 and a barrel part 26 supported within bore 20 of cylinder 8. Stem 23 supports a cap 21 threadably mounted at one end for contacting the breaker tripping mechanism (not shown) and threads 25 within barrel 26. A collar 24 is formed on stem 23 in order to retain part of the armature within the winding by contacting the stop when the armature becomes extended. As described in the aforementioned patents relating to static trip circuit breaker units, a permanent magnet 13A holds the armature 19 against the spring force exerted on cap 21 by helical compression spring 22. Upon the occurrence of a fault, winding 6 become energized and produces a magnetic field in oppostion to the field produced by permanent magnet 13A. The magnetic flux produced by the magnet becomes directed via flux diverter 16 through the opposing sidewalls 14, 15 such that the resulting magnetic force on armature 19 is insufficient to oppose and overcome the spring force exerted on cap 21 by helical compression spring 22. The armature then becomes extended bringing cap 21 into contact with a circuit breaker tripping latch causing the associated circuit breaker to trip. However, as described in aforementioned U.S. Pat. Nos. 4,288,769 and 4,288,770, the enclosure which contains the circuit breaker and associated static trip electronic components can rise to a temperature high enough to affect the sensitive electronic components while the current through the breaker is insufficient to energize the trip unit. In order to sense and respond to excessively high ambient temperature conditions, the armature 19 is arranged such that the threads 25 on stem 23 are in a close fit with the internal threads 27 within barrel 26, and a meltable material 28 consisting of a low melting point metal alloy, meltable resin or meltable adhesive is provided intermediate threads 25 and threads 27 in barrel 26. Upon reaching a predetermined melting temperature, such as in excess of 80° C. for example, material 28 softens and allows stem 23 to separate from barrel 26 under the action of the spring force provided by helical compression spring 22.

Suitable examples of metals having melting temperatures approximately equal to or greater than 80° C. are alloys of indium, gallium, tin and lead. Resins which are thermoplastics and are capable of repeated melting and solidification for use within the instant invention are thermoplastic polymers, styrene resins, vinyl resins and polyethylene. Adhesives which hold tenaciously at ordinary temperatures and which soften and melt at higher temperatures are polyimides, acrylics and latex.

Figure 2:
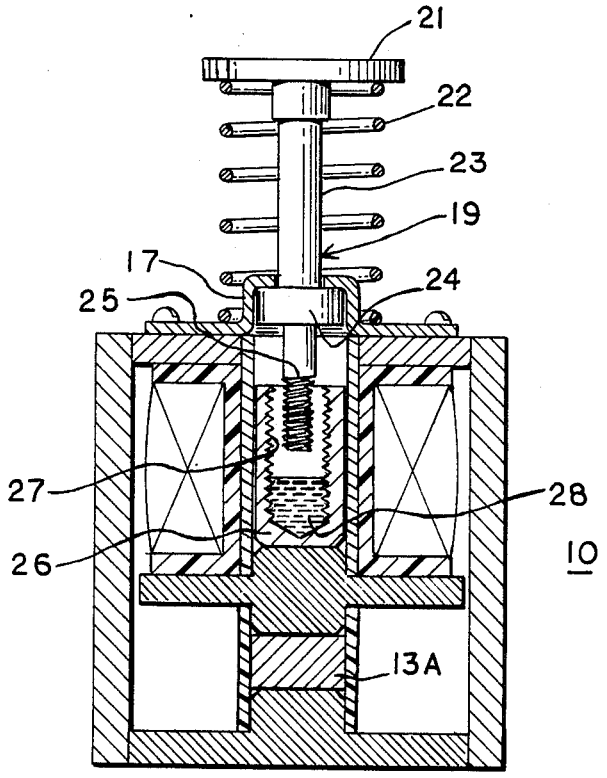
FIG. 2 is a side view in partial section; of the device depicted in FIG. 1 with the solenoid armature extended.

Cap 21 is shown extended under the force provided by helical compression spring 22 in FIG. 2 with stem 23 fully extended forward and collar 24 in contact with stop 17. Threads 25 of stem 23 become completely separated from threads 27 in barrel 26. Material 28, which is still at the predetermined melting temperature, remains in liquid form. When the associated breaker is in either the tripped or off position, cap 21 on the end of stem 23 is forced back against helical compression spring 22 bringing the threads 25 into contact with material 28 in the position as shown in FIG. 1. If the ambient temperature falls below the predetermined temperature, such that material 28 can solidify, then stem 23 is held within barrel 26, and the entire armature 19 consisting of stem 23 and barrel 26 is held by the magnetic force provided by permanent magnet 13A.

If the ambient temperature within the breaker enclosure still remains in excess of the melting temperature of material 28, any attempt to latch the breaker will cause stem 23 to again become extended causing the associated breaker to retrip. This retripping after latching is a clear indication that steps must be taken to correct the cause of overheating.

Having described my invention, what I claim as new and desire to secure by Letters Patent is:

1. A flux shift trip unit for static trip circuit breakers comprising:

a casing;

a solenoid within said casing consisting of an electrically responsive winding around an armature consisting of a first part and a second part held together by meltable means responsive to ambient temperature variation;

a spring arranged with the armature for extending said armature into tripping relation with an associated circuit breaker; and magnet means in flux relation with said armature for holding said armature in opposition to said spring.

2. The flux shift trip unit of claim 1 wherein said first armature part is retained within said second armature part.

3. The flux shift unit of claim 1 wherein said meltable means is intermediate said first and second armature parts.

4. The flux shift trip unit of claim 2 wherein said first armature part contains an external threaded surface within said second armature part.

5. The flux shift trip unit of claim 1 wherein said meltable means has a predetermined melting point equal to or in excess of 80° C., said first and second armature parts become separated when said predetermined melting point is exceeded, to allow said first armature part to become extended.

6. The flux shift trip unit of claim 1 wherein said meltable means is selected from the group consisting of metals, resins and adhesives.

7. The flux shift trip unit of claim 6 wherein said metals comprise a metal alloy.

8. The flux shift trip unit of claim 6 wherein said resins comprise thermoplastics.

9. The flux shift trip unit of claim 6 wherein said metals are selected from the group consisting of indium, galium, tin and lead.

10. The flux shift trip unit of claim 1 further including a metallic flux diverter element subjacent said solenoid for providing a magnetic flux transfer path between said armature and said casing.

11. A circuit breaker flux shift trip unit having ambient temperature response comprising:

a casing of magnetically susceptible material;

a solenoid carried by said casing and consisting of an electrical winding arranged around a two-part armature, said two parts being held together by a meltable alloy, resin or adhesive;

a permanent magnet carried by said casing in flux relation to said armature; and spring means providing motive force to said armature in opposition to said permanent magnet.

12. The flux shift trip unit of claim 11 further including a flux diverter consisting of a magnetically susceptible material proximate said solenoid for providing a flux transfer path between said armature and said casing.

13. The flux shift trip unit of claim 11 wherein said meltable alloy, resin or adhesive melts at a predetermined ambient temperature to cause said two armature parts to become separated whereby one of said armature parts becomes extended under said spring force.

14. The flux shift trip unit of claim 13 wherein said predetermined temperature is equal to or greater than 80° centigrade.

* * * * *